US006138423A

United States Patent [19]

Poutanen et al.

[11] Patent Number: 6,138,423

[45] Date of Patent: Oct. 31, 2000

[54] FACING PANEL

[75] Inventors: Tuomo Poutanen, Tampere; Tuomo Tiirola, Jyväskylä, both of Finland

[73] Assignee: Stonel Oy, Jyvaskyla, Finland

[21] Appl. No.: 08/983,151

[22] PCT Filed: Jul. 12, 1996

[86] PCT No.: PCT/FI96/00411

§ 371 Date: Apr. 29, 1998

§ 102(e) Date: Apr. 29, 1998

[87] PCT Pub. No.: WO97/04198

PCT Pub. Date: Feb. 6, 1997

[30] Foreign Application Priority Data

Jul. 14, 1995 [FI] Finland ..... 953432

[51] Int. Cl.[7] ..... E04F 15/022

[52] U.S. Cl. ..... 52/384; 52/386; 52/387; 52/311.2; 52/314

[58] Field of Search ..... 52/384, 386, 387, 52/389, 311.2, 314

[56] References Cited

U.S. PATENT DOCUMENTS 1,975,769 10/1934 Cederholm et al .
2,651,852 9/1953 Hirsch ..... 52/311.2
3,005,293 10/1961 Hunter .
3,672,112 6/1972 Sions et al. .
4,516,373 5/1985 Osawa .
4,947,600 8/1990 Porter .
5,333,428 8/1994 Taylor et al. ..... 52/311.2

FOREIGN PATENT DOCUMENTS 2227765 8/1990 United Kingdom ..... 52/311.2

*Primary Examiner*—Carl D. Friedman
*Assistant Examiner*—Phi Dieu Tran A
*Attorney, Agent, or Firm*—Andrus, Sceales, Starke & Sawall

[57] ABSTRACT

A wall element for a building, especially a lining element used as a facing panel, the front of which is formed of brick, ceramic or similar tiles (1), the joints of which are most advantageously filled with jointing compound. The panel body comprises vertical profiles (2) at a distance from each other and horizontal profiles (3, 8) at a distance from each other, forming a lattice when fixed together, and profiles (2, 3) furnished with guides (4, 5) to facilitate laying of tiles (1) on said profiles.

8 Claims, 2 Drawing Sheets

FIG. 4
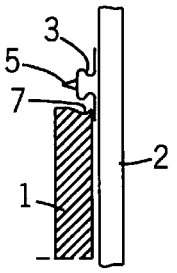
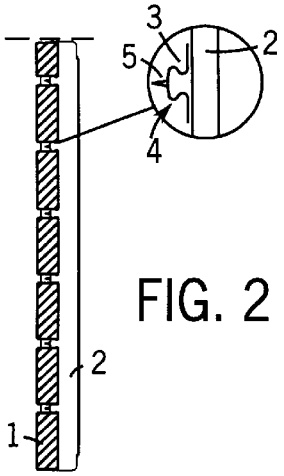
FIG. 2
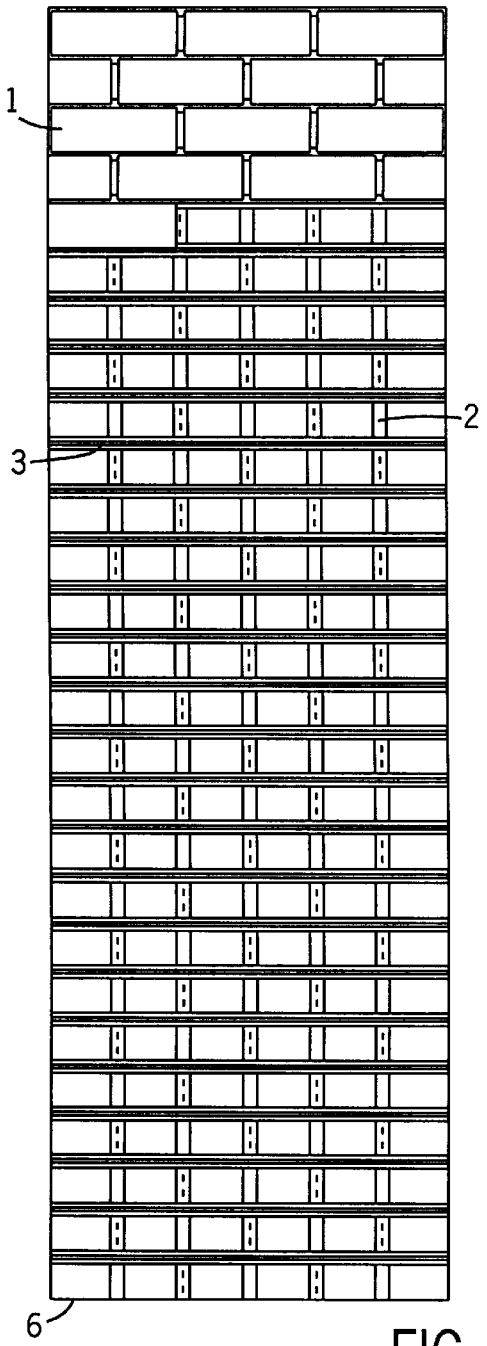
FIG. 1
FIG. 3
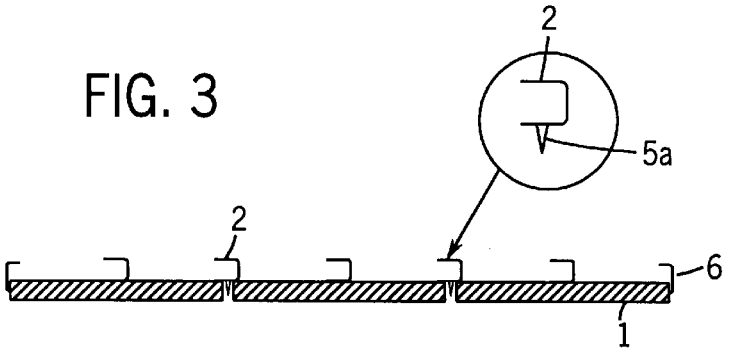

FACING PANEL

BACKGROUND OF INVENTION

This invention relates to a plane element to be used as a facing panel on the exterior surface in buildings.

Previously known is a facing panel (2) with a body of corrosion resistant sheet metal. By means of punching tools tiling guides have been made in the sheet which are tongues extracted from the sheet with the tool and bent off the sheet in the direction of the tiling. Guided by the tongues, the tiles are laid and jointed.

To be transportable and mountable, such a facing panel needs extra support. The back sheet must be stiff if used to provide handling strength to the panel. The panel will then be heavy and have a thickness of many millimeters. Known panels of this kind are, as matter of fact, facing panels with insulation, frame and inwall lining. Accordingly, on using thin sheet the panel requires a separate supporting framework. Examples of such frameworks are constructions a.o. in U.S. Pat. No. 4,334,394, in the Finnish application No. 884288 and in the publication print No. FI-58810. The panels are as thick as the whole wall and have a thin back plate for fixing of tiles, concrete or casting material.

SUMMARY OF THE INVENTION

The object of this invention is to bring forth a facing panel sufficiently rigid upon handling and mounting and onto which especially tiles, e.g. lining bricks are easily fastened. The panel is fixed on a wall as a lining. This object is reached by a means of facing panel according to the invention, characterized in what is presented in the patent claims.

A facing panel according to the invention is made sufficiently rigid by means of a lattice structure, the vertical profiles of which are made of thin sheet metal. The whole profile construction, which functions as the panel back plate, is formed from sheet metal material. With a framework of profiles according to the invention the facing panel needs no other bearing frame and can therefore be handled and mounted independently as a facing panel on a wall. For laving the tiles or lining bricks and distribution of jointing compound there are necessary guides in the profiles for the tiles and bearing surfaces for jointing compound.

BRIEF DESCRIPTION OF THE SEVERAL VIEWS OF THE DRAWING

In the following the invention is disclosed with reference to the enclosed drawing, where FIG. 1 is a front view of the facing panel.

FIG. 2 is a vertical view of the facing panel.

FIG. 3 is a horizontal view of the facing panel.

FIG. 4 is a joint of tile and horizontal profile.

DETAILED DESCRIPTION OF THE INVENTION

Figure 5:
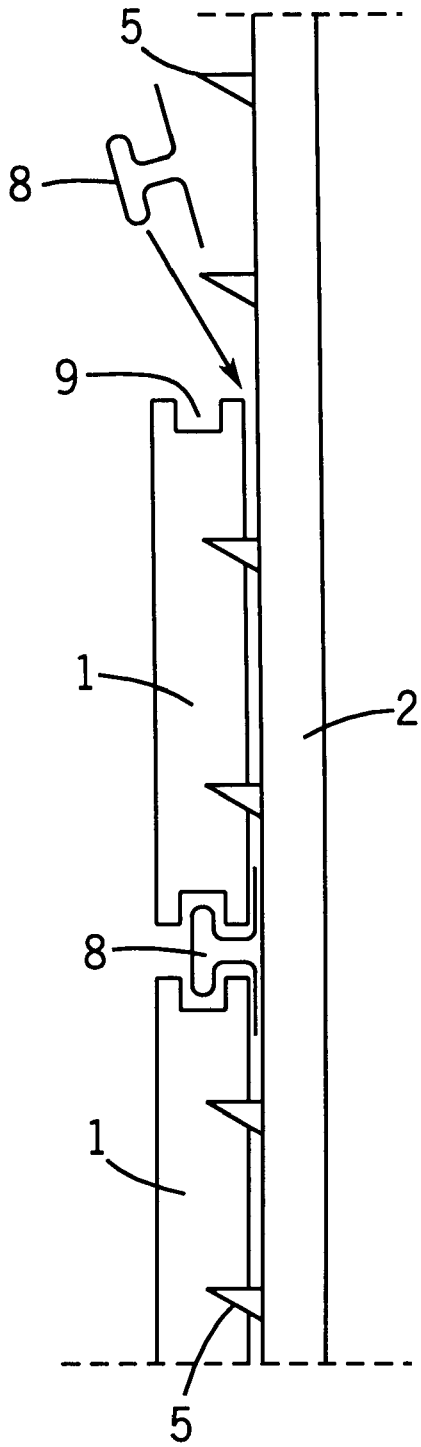
FIG. 5 is another joint of tile and horizontal profile.

FIG. 1 shows the facing panel framed by a L-profile 6. Inside the frame a lattice of vertical and horizontal profiles is formed. The vertical profiles 2 are fixed at a pitch of half of the tile length from each other. The horizontal profiles 3 are fixed at a pitch of half of the tile width from each other. Most suitably the profiles are shaped of corrosion resistant thin metal sheet. The profiles are fixed together as a lattice for instance by spot welding in the intersections. Profiles 2 and 3 are then at different levels and, most advantageously, the vertical profiles are undermost. The vertical profiles 2 have tile guide brackets 5 in every second space between the horizontal profiles 3. Most advantageously the tile guides 5 are made punching them partly off profile with a tool to form tongues sticking out from the profile. The tile pattern shown in the figure is produced with tile guides 5 in every second space in the vertical profiles 2. The purpose of tile guides 5 is to function as tiling guides and bearing surfaces for the jointing compound.

As tiling guide and bearing surface for the jointing compound the surface of horizontal profile 3 can have an unbroken profile shape 4 similar to the bracket shown in FIG. 1. Naturally, on the surface of this profile 3 there can also be brackets partially punched out with a tool at a distance from each other.

The profiles of the lattice can be fixed together also with a punching tool by percussing them partly through both profiles in the intersections and thus producing a joint locking the profiles together. Other know jointing methods are also possible.

FIG. 2 shows a vertical section of the facing panel, whereat a cross-section of horizontal profile 3 becomes visible. There are folds in the edges of profile 3 by means of which the profile can be easily connected, in different ways, to the criss-cross profile 2 underneath. Further, profile 3 has a protruding shape 4 hitting the joint space between the tiles. The width of the joint space is determined by profile 3 when the tiles are arranged as shown in FIG. 2, i.e. the tile edges are placed on the skirts of the edges of profile 3.

FIG. 3 shows a horizontal section of the facing panel, whereat a cross-section of vertical profile 2 becomes visible. In this embodiment the vertical profile is a U channel, on the one side of which the horizontal profiles are fixed. On the same side the tiles guides 5*a* are also made. Depending on the tiles, the thickness of tiling varies for instance from 8 to 30 mm and the width of the profile is for instance 30 mm. Accordingly, the width of the facing panel amounts only to appr. 60 mm. The outer dimensions of a typical facing panel are 1 m×2,7 m.

FIG. 4 shows another embodiment of this invention, where there is a groove 7 in the tile 1 edge. Further, the shape of the edge of vertical profile 2 differs from the shape in FIG. 2 because it is bent inward. For the jointing compound a nest is formed because of the vertical profile 2 and the groove in tile 1. The next has the effect to bind tile 1 to the profiles if it has been made sure during jointing that the nest is filled with jointing compound. The next can be on one side of the profile 3 and have an uninterruped shape or it is produced in form of pits pressed in profile 3 at a certain distance from each other. In the tiles 1 as per the figures, the grooves 7 are, for instance, on the long sides of the tiles.

The next can be also formed between tile 1 with groove 7 and a vertical profile 2 as shown in FIG. 2 so that there is on one side of the vertical profile holes made at distance from each other, which hit the groove 7, whereby the jointing compound extrudes through the holes partly to the inside of profile 3. In this manner a corresponding locking effect is reached.

The groove in the edge of tile 1 can be replaced by pits or with a uninterrupted or interrupted bulge.

Further, a tile guide 5 is partly punched off from profile 3 is also illustrated in FIG. 4. Such tile guides 5 are used at a distance from each other to function as bearing surface for the jointing compound.

FIG. 5 shows tiles 1 furnished with still deeper grooves 9 and a horizontal profile 8 still comprising bracket shapes in both directions designed so that the bracket wings hit grooves 9 in tile 1 to keep the tiles mechanically fastened by profiles 8 even without any jointing compound. Also in this embodiment the intention is to add also jointing compound between the tiles. This construction is of such a kind that the tiles and the next horizontal profile 8 are laid and mounted in turns. A solution may also be pushing the tiles sidewards to their place if the horizontal profiles 8 are mounted in the vertical profiles. Guides (5) have to be bent up later in this case.

The lattice offers sufficient rigidity and most characteristically it is made of steel sheet band with a thickness of 0,5 mm. The shape of profile is made most advantageously by rolling the sheet band. The use of material corresponds to the material used in a compact back board.

The facing panel can be easily made more rigid and fixing of tiles improved by spraying adhesive onto the back of the facing panel, for instance glass fibre resin together with or without reinforcing fibres. Fixing means close to the corners with counter parts on the wall, are sufficient for mounting the panel on a wall. It is possible to make various facing panel shapes needed due to deviations caused by window and door openings. Likewise, as a corner element a facing panel can be used with its sides in a 90° angel to each other.

For each facing panel size the latice shall be built with proper spaces between profiles so that guides and bonds fall in the joint space. Tiling is most advantageously carried out with a facing panel in vertical position while jointing is carried out simultaneously.

The body material of profiles can be aluminum, polymer plastic or even carbon fibre in addition to corrosion protected sheet metal profile. The facing panel is well applicable also to fences, for instance shielding fences alongside roads, inwalls and floor levels.

We claim:

1. A facing panel for attachment to a wall, the facing panel comprising:

a plurality of vertical profiles (2) spaced at a distance from each other, each of the vertical profiles including a plurality of protruding tile guides (5);

a plurality of horizontal profiles (3) spaced at a distance from each other and attached to the vertical profiles to form a lattice therewith, each of the horizontal profiles including a plurality of protruding tile guides (5); and a plurality of tiles (1) positioned in horizontal rows between the spaced horizontal profiles, the tiles being positioned on the surface of the vertical profiles, each of the tiles being spaced vertically and horizontally from each other by jointing spaces;

wherein the spacing guides on both the vertical profiles and the horizontal profiles are positioned within the jointing spaces between the tiles and the horizontal profiles are positioned within the jointing space between adjacent horizontal rows of tiles.

2. The facing panel according to claim 1 wherein the vertical and horizontal profiles function as a mounting bolster for jointing compound filled into the jointing space between adjacent tiles.

3. The facing panel according to claim 1 wherein the tile guides (5) are protruding tongues formed as a result of punching the respective horizontal and vertical profile (2), (3).

4. The facing panel according to claim 2 wherein the tile guides (5) are protruding tongues formed as a result of punching the respective horizontal and vertical profile (2), (3).

5. The facing panel according to claim 1 wherein the tile guide formed on the horizontal profile protrudes from the horizontal profile in a horizontal direction.

6. The facing panel according to claim 2 wherein the tile guide formed on the horizontal profile protrudes from the horizontal profile in a horizontal direction.

7. The facing panel according to claim 1 wherein a layer of adhesive is sprayed on the back of the facing panel for more effective fixation of the tiles on the vertical and horizontal profiles.

8. The facing panel according to claim 2 wherein the horizontal edges of each tile include a groove (7), (9) in order to improve the adhesive effect of the jointing compound to secure the tile between the horizontal profiles (8).

* * * * *